United States Patent [19]

Burgio di Aragona

[11] 4,440,348

[45] Apr. 3, 1984

[54] FUEL INJECTION DEVICE FOR DIESEL ENGINES WITH PRECOMBUSTION CHAMBERS

[75] Inventor: Antonio Burgio di Aragona, Moncalieri, Italy

[73] Assignee: Fiat Auto S.p.A., Turin, Italy

[21] Appl. No.: 294,643

[22] Filed: Aug. 20, 1981

[30] Foreign Application Priority Data

Sep. 2, 1980 [IT] Italy ..... 68357 A/80

[51] Int. Cl.[3] ..... B05B 1/26

[52] U.S. Cl. ..... 239/533.12

[58] Field of Search ..... 239/533.3, 533.12

[56] References Cited

U.S. PATENT DOCUMENTS

| | | | |
|---|---|---|---|
| 3,035,780 | 5/1962 | Peras | 239/533.12 X |
| 4,254,915 | 3/1981 | Muller | 239/533.12 |
| 4,273,291 | 6/1981 | Muller | 239/533.12 |
| 4,275,845 | 6/1981 | Muller | 239/533.12 |

FOREIGN PATENT DOCUMENTS

| | | | |
|---|---|---|---|
| 703194 | 1/1941 | Fed. Rep. of Germany | 239/533.12 |
| 662061 | 6/1938 | Fed. Rep. of Germany | 239/533.12 |

*Primary Examiner*—John J. Love

*Attorney, Agent, or Firm*—Sughrue, Mion, Zinn, Macpeak, and Seas

[57] ABSTRACT

The invention relates to an injector for diesel engines with precombustion chambers, particularly of the low turbulence type, including an atomizer nozzle in which a needle slides to act as a shutter member for controlling the fuel flow towards an outlet hole in dependence upon the rate of flow of the fuel fed to the atomizer nozzle, and has a terminal portion which includes a cylindrical part, a tapering frusto-conical part and a shaped end part. In order to prevent the formation of carbonaceous deposits on the terminal portion of the needle, the latter has at least one flat face lying in a plane tangential to the periphery of the smaller end of the frusto-conical part.

10 Claims, 6 Drawing Figures

FUEL INJECTION DEVICE FOR DIESEL ENGINES WITH PRECOMBUSTION CHAMBERS

The present invention relates to a fuel injection device for diesel engines with precombustion chambers, including an atomizer nozzle body having a fuel supply duct and an outlet opening, a needle mounted for axial sliding movement in the body of the atomizer nozzle and having a guide portion, an intermediate portion which acts as a valve shutter member for controlling the fuel flow from the supply duct to the outlet opening dependent upon the pressure of the fuel in the supply duct, and a terminal portion which extends through the outlet opening and includes a cylindrical part, a frusto-conical part tapering in the direction of fuel outflow, and an end part shaped so as to impart the desired form to the jet of fuel issuing from the outlet opening in use.

In injectors provided with fuel nozzles of the type specified above, the end part of the needle is normally frusto-conical; in the case of engines with low turbulence precombustion chambers the frustum widens in the direction of fuel outflow from the outlet opening of the atomizer nozzle.

It has been found in practice that carbonaceous deposits form on the end part of the needle of the atomizer nozzle, giving rise to an increase in the noise (knocking), power loss and an increase in the smokiness of the engine exhaust.

These carbonaceous deposits form in the transition zone between the tapering frusto-conical part of the needle and the frusto-conical end part, which has a different taper from that of the frusto-conical part preceding it. Since the fuel outflow does not, in fact, pass over this transition zone, a low-pressure area is created which favours the deposition of varnish which, due to the high temperature, gives rise to the carbonaceous deposits mentioned above. The accumulation or carbonaceous deposits on the end of the needle alters the fuel outflow cross-section and, as a consequence, reduces the discharge of fuel during injection or prolongs the time necessary for injection. Thus, the progress of the combustion is altered, with the resulting operational disadvantages of the engine mentioned above arise.

The present invention, in order to avoid the disadvantages mentioned above, provides an injection device of the aforesaid type which is characterised by the fact that the side surface of the end part of the needle has at least one flat face which lies in a plane tangential to the circumference defining the periphery of the smaller end of the tapering frusto-conical part.

The separation of the jet of fuel from the surface of needle is avoided in correspondence with the flat face, or each of the flat faces (normally at least two), on the needle, so that the main cause of the formation of carbonaceous deposits is eliminated.

The invention will now be described with reference to the appended drawings, provided purely by way of non-limiting example in which.

Figure 1:
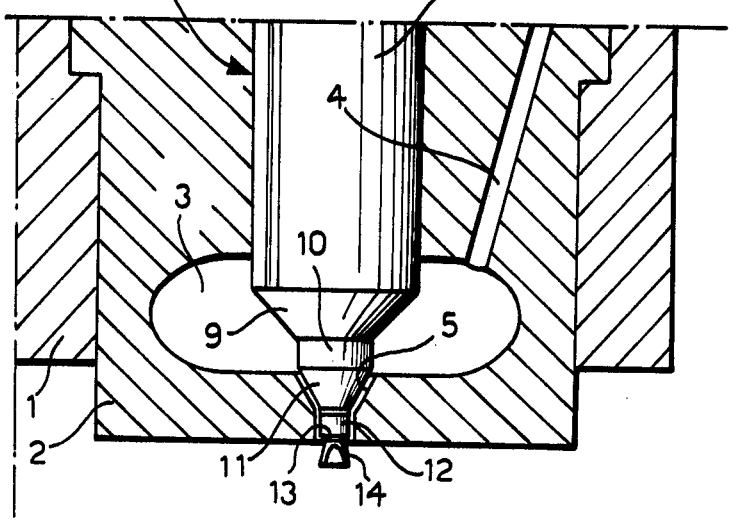
FIG. 1 is a partial axial section of an injector, for diesel engines with precombustion chambers, according to the invention.
Figure 2:
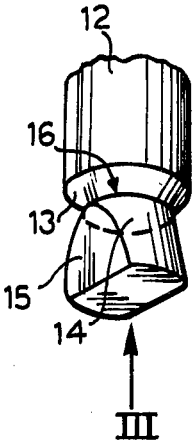
FIG. 2 is a perspective view on an enlarged scale of the end part of the needle of the injector illustrated in FIG. 1.
Figure 3:
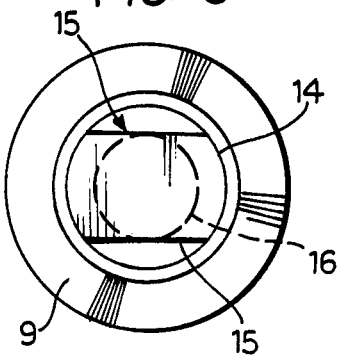
FIG. 3 is a view from the bottom of FIG. 2.

With reference to FIGS. 1 to 3, an atomizer nozzle holder of an injector for diesel engines with low-turbulence precombustion chambers is indicated 1.

The body 2 of the atomizer nozzle is formed with a chamber 3 into which fuel is fed under pressure through a supply duct 4. The chamber 3 communicates through a frusto-conical duct 5 with a cylindrical fuel outlet opening 6.

A needle 7 is slidably mounted in the body 2 of the atomizer nozzle.

The needle 7 includes a first cylindrical guide portion 8, and a first frusto-conical portion 9 which tapers towards the outlet opening 6 and is situated in the chamber 3.

The frusto-conical portion 9 is connected, through a second cylindrical portion 10, to a second frusto-conical portion 11 which tapers towards the outlet opening 6 and cooperates, in the form of a valve shutter, with the seat constituted by the frusto-conical duct 5, to control the flow of fuel through the outlet opening 6 in dependence on the pressure of the fuel fed to the chamber 3.

The frusto-conical portion 11 is maintained against the tapering seat 5 by a spring (not illustrated) which acts on the guide part 8, whereby the needle is lifted to open the passage for the fuel when the latter exerts a greater thrust than the spring on the frusto-conical surface 9 of the needle.

The needle 7 has a terminal portion which extends through the outlet opening 6 and comprises a cylindrical part 12, a frusto-conical part 13 tapering in the direction of the fuel flow to the outlet, and an end part 14 shaped so as to impart the desired form to the jet of fuel issuing from the outlet opening.

In the illustrated example, the end part 14 of the needle 7 has generally frusto-conical shape which widens in the fuel flow direction and has two opposing flat faces 15, lying in a plane parallel to the axis of the injector and tangential to the circumference defining the periphery of the smaller end of the tapering frusto-conical part 13 of the needle 7.

As is clear from FIG. 2, the phenomenon of separation of the fuel jet from the needle in the transition zone between the frusto-conical part 13 and the end part of the needle is considerably lessened in correspondence with each of the faces 15, whereby the formation of carbonaceous deposits is significantly reduced.

Figure 4:
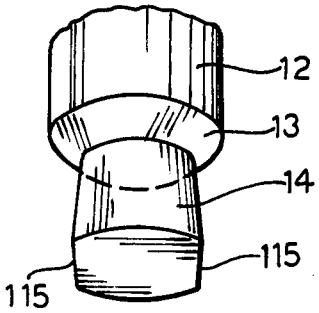
FIG. 4 is a view similar to FIG. 2 of a first variant embodiment.

In the variant illustrated in FIG. 4, as in the example of FIGS. 1 to 3, the end part of the needle has a generally frusto-conical shape 14 with two flat faces 115 which are opposite each other and lie in two planes which are slightly divergent in the direction of fuel flow forming, for example, an angle of the order of 4° with the axis of the needle 7.

Figure 5:
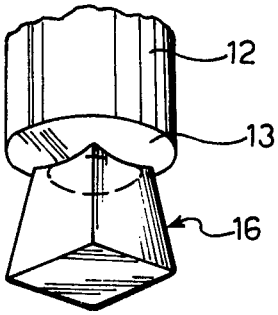
FIG. 5 is a view similar to FIG. 2 of a second variant embodiment.
Figure 6:
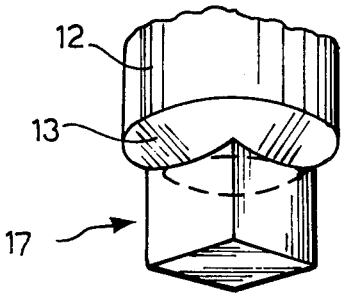
FIG. 6 is a view similar to FIG. 2 of a third variant embodiment.

In the variants illustrated in FIGS. 5 and 6, the end part of the needle has a side surface constituted exclusively by a plurality of flat faces.

In the example of FIG. 5, the end part 16 is in the form of a truncated pyramid, and in the example of FIG. 6 the end part of the needle is in the form of a cube 17.

I claim:

1. Fuel injection device for diesel engines with precombustion chambers, including an atomizer nozzle body (2) having a fuel supply duct (4) and an outlet opening (6), a needle (7) mounted for axial sliding movement in the atomizer nozzle body (2) and having a guide portion (8), an intermediate portion (9,10,11) which acts as a valve shutter member for controlling the fuel flow from the supply duct (4) to the outlet opening (6) in dependence on the pressure of the fuel in the supply duct (4), and a terminal portion (12,13,14) which extends through the outlet opening (6) and includes a cylindrical part (12), a frusto-conical part (13) tapering in the direction of the fuel outflow, and an end part (14) shaped so as to impart the desired form to the jet of fuel issuing from the outlet opening (6) in use, characterised in that the side surface of the end part (14) of the needle (7) has at least two flat faces (15) disposed on opposite sides of said end part, each of which lies in a plane tangential to the circumference defining the periphery of the smaller end (16) of the tapering frusto-conical part (13).

2. Device according to claim 1, characterised in that each of said flat faces (15) lies in a plane parallel to the axis of the needle (7).

3. Device according to claim 1, characterised in that each of said flat faces (15) lies in a plane slightly inclined to the axis of the needle (7).

4. Device according to claim 1, characterised in that the end part (14) of the needle (7) has a generally frusto-conical shape which widens in the direction of fuel outflow from the outlet duct (6) and has said two flat faces (15) opposite each other.

5. Device according to claims 1,2, and 4, characterised in that the two flat faces (15) lie in two parallel planes.

6. Device according to claims 1,3 and 4, characterised in that the two flat faces (115) lie in two planes which are slightly divergent in the direction of the fuel flow.

7. Device according to claim 6, characterised in that each of the flat faces (115) forms an angle of the order of 4° with the axis of the needle (7).

8. Device according to claim 1, characterised in that the end part (16,17) of the needle (7) has a side surface constituted exclusively by a plurality of flat faces.

9. Device according to claim 8, characterised in that the end part of the needle (7) is in the form of a truncated pyramid (16).

10. Device according to claim 1, characterised in that the end part of the needle (7) is in the form of a parallelepiped (17).

* * * * *